United States Patent [19]

Atalla et al.

[11] Patent Number: 4,816,973

[45] Date of Patent: Mar. 28, 1989

[54] PORTABLE NIGHT LIGHT AND AIR FRESHENER

[75] Inventors: Anwar A. Atalla, Glen Ellyn; Swin, Sr., Richard E., Indianhead Park, both of Ill.

[73] Assignee: Tec-Air, Inc., Willow Springs, Ill.

[21] Appl. No.: 231,927

[22] Filed: Feb. 6, 1981

[51] Int. Cl.[4] ..... F21V 33/00

[52] U.S. Cl. ..... 362/226; 362/101; 362/149; 362/801

[58] Field of Search ..... 362/96, 226, 101, 147, 362/149, 190, 218, 801

[56] References Cited

U.S. PATENT DOCUMENTS 1,824,388 9/1931 Birch ..... 362/96
3,248,530 4/1966 Titmas ..... 362/226
3,443,083 5/1969 Curran ..... 362/226

FOREIGN PATENT DOCUMENTS 2230936 12/1974 France ..... 362/96

*Primary Examiner*—Donald P. Walsh
*Attorney, Agent, or Firm*—Wall and Roehrig

[57] ABSTRACT

A socket-mounted illuminating and air freshening device which is adapted to be supported on a conventional electrical wall outlet socket to provide, alternatively or simultaneously, illumination and circulation of air through an air freshening material. The device of the invention is light weight and is inexpensive to operate even in simultaneous illumination and air circulating modes. The device is capable of a wide versatility of use and may be oriented in any direction for effective operation.

2 Claims, 3 Drawing Sheets

FIG. 1
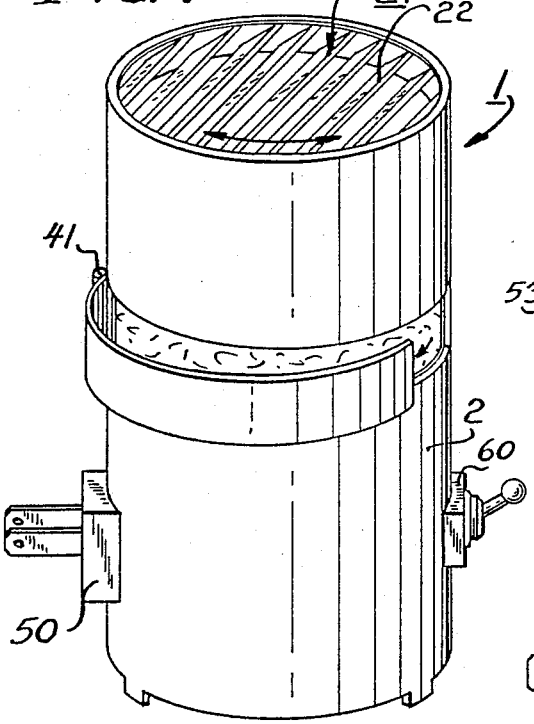
FIG. 2
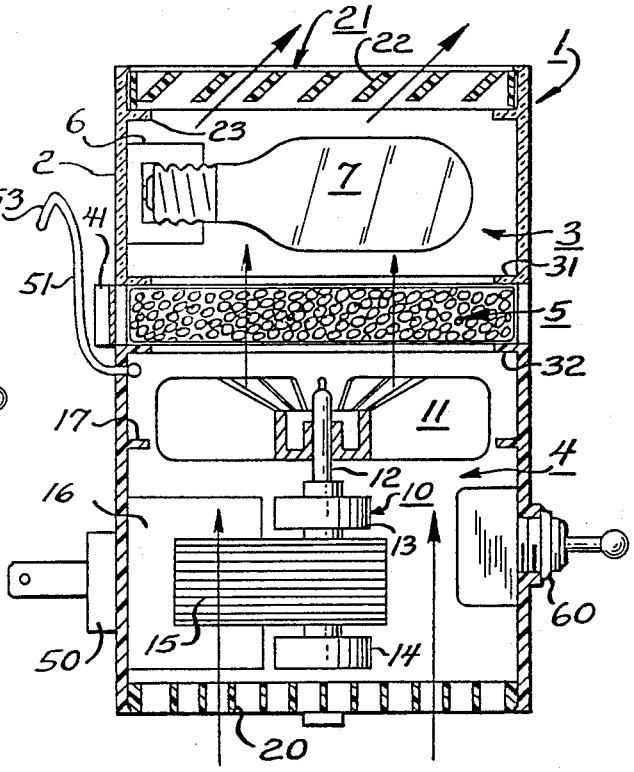
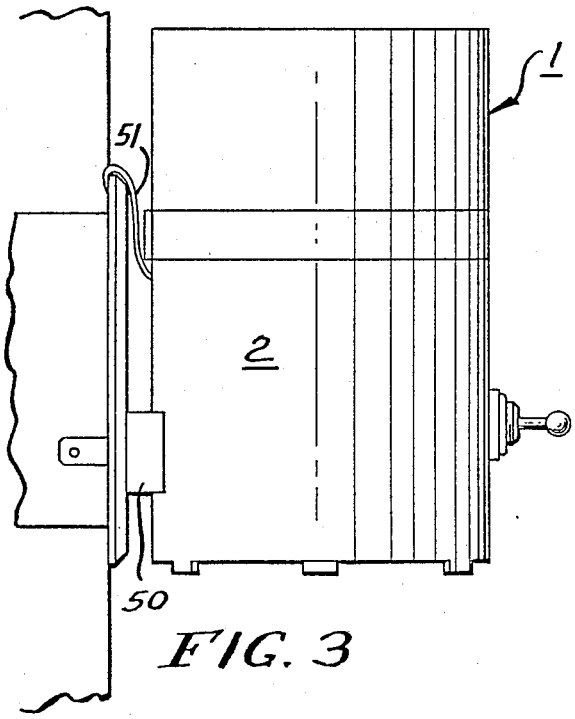
FIG. 3
FIG. 4
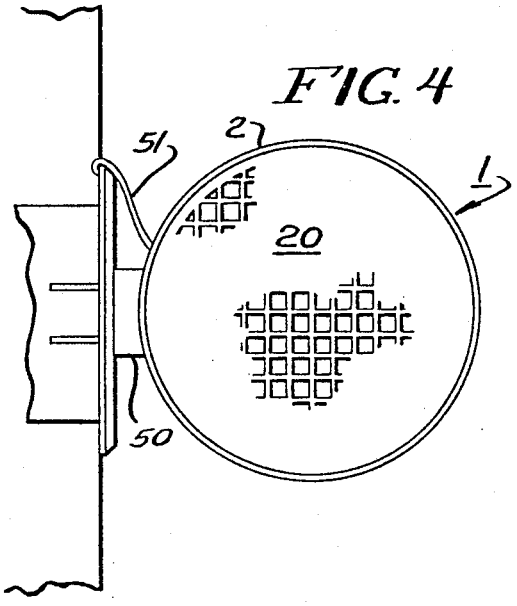

PORTABLE NIGHT LIGHT AND AIR FRESHENER

BACKGROUND OF THE INVENTION

This invention relates in general to illuminating and air circulating devices and, in particular, to an illuminating and air circulating device which is portable and adapted to be affixed to a standard electrical wall socket.

This invention relates to a portable socket-mounted light and air freshener device that provides both exterior illumination and air circulation through generation of an air flow in conjunction with an air freshener composition. The socket-mounted light and air freshener of the invention is capable of being coupled to a conventional electrical wall socket for physical support thereon.

It is well known to attach an illuminating device to a wall socket and the like, such as, to provide light in a darkened room, whereby such lights are generally small and are readily moved from room to room as needed. However, these previous portable illuminators have solely been intended to provide light without possessing a capability of improving the quality of air in the surrounding area.

Known devices, which are adapted to produce both an illumination and air circulation, typically require physical installation within a room, or are relatively large and bulky and are not suited for portability and economy of operation or manufacture. The incorporation of the dual provisions of light and air freshening, such as accomplished by circulation of an air flow through an air freshening material, is highly desirable under many numerous conditions, such as, in the rooms of homes, offices, and the like. However, the lack of portable mobility of typical fan/light assemblies renders them undesirable for general low cost and non-permanent application. In addition, prior art devices of this type often are relatively inefficient and costly to operate for sustained period of time.

SUMMARY OF THE INVENTION

It is, therefore, an object of this invention to improve devices combining illumination with air freshening or circulating capabilities;

Another object of this invention is to combine illumination with air freshening or circulating capabilities in a portable device;

A further object of this invention is to secure an illuminating and air freshening device to an electrical wall socket;

Still another object of this invention is to provide an energy efficient illuminating and air circulating device.

These and other objects are attained in accordance with the present invention wherein there is provided a socket-mounted illuminating and air freshening device which is adapted to be supported on a conventional electrical wall outlet socket to provide, alternatively or simultaneously, illumination and circulation of air through an air freshening material. The device of the invention is light weight and is inexpensive to operate even in simultaneous illumination and air circulating modes. The device is capable of a wide versatility of use and may be oriented in any direction for effective operation.

BRIEF DESCRIPTION OF THE DRAWINGS

Further objects of the invention together with additional features contributing thereto and advantages accruing therefrom will be apparent from the following description of two preferred embodiments of the invention which are shown in the accompanying drawings with like reference numerals indicating corresponding parts throughout, wherein:

FIG. 1 is a side perspective illustration of a first embodiment of the novel illuminating and air freshening device of the invention;

FIG. 2 is a side view, with parts in section, of the illuminating and air freshening device of FIG. 1;

FIG. 3 is a side view of the illuminating and air freshening device of FIG. 1 mounted on a conventional vertically oriented electrical wall socket;

FIG. 4 is a side view of the illuminating and air freshening device of the invention mounted on a conventional horizontally oriented electrical wall socket;

DESCRIPTION OF THE PREFERRED EMBODIMENTS

Figure 6:
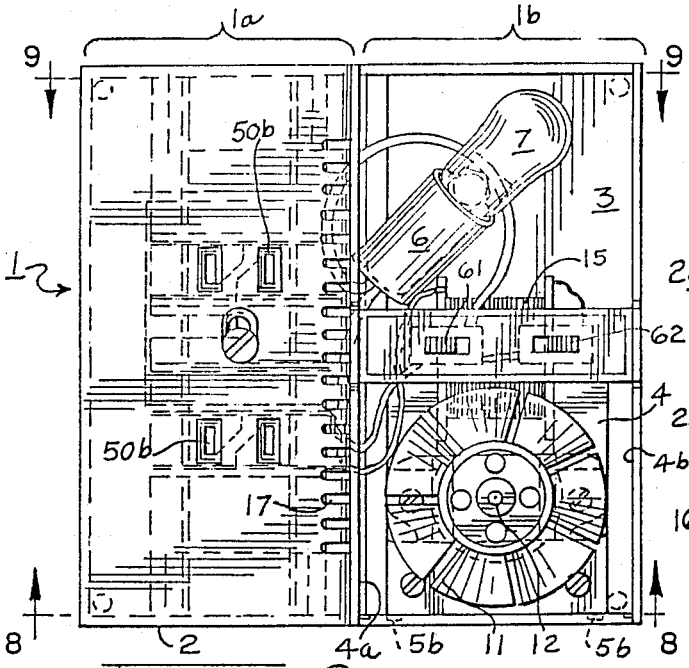
FIG. 6 is a frontal profile view of the embodiment shown in FIG. 5 with parts removed to better illustrate the internal construction thereof.
Figure 7:
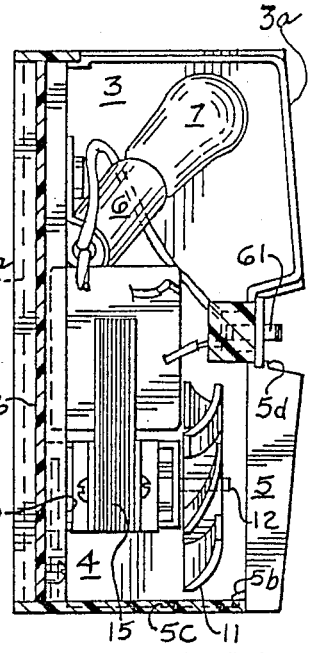
FIG. 7 is a cross-sectional view of the embodiment shown in FIG. 5 taken along line 7—7.

Referring now to FIGS. 1 and 2, there is illustrated the portable illuminating and air freshening device of the invention. The first embodiment of the illuminating and air freshening device is generally designated by the reference number 1, and includes a hollow and open-ended housing or casing 2 fabricated from any suitable material, such as, metal, plastic, and the like. The housing 2 is shown having a cylindrical configuration, but it is within the scope of the invention to utilize other shapes.

The interior of housing 2 is divided into two compartments 3 and 4, separated by an air freshener section 5 to be described in detail later. The upper illuminating compartment 3 contains a standard light bulb socket 6 mounted on a sidewall of the housing 2 for receiving a conventional incandescent lamp 7. The portion of housing 2 surrounding upper illuminating compartment 3 is preferably framed form a suitable transparent or translucent material extending partially or entirely about the bulb to permit light to be directed outwardly from the device. In addition, the housing may be provided with slots or an opening permitting light to pass therethrough, or light may be directed solely through the upper end of housing 2.

As shown in FIG. 2, an air circulating system 10 comprising a rotatable fan or impeller 11, is secured to a shaft 12 within compartment 4. The shaft 12 is journaled on suitable spaced bearing assemblies 13 and 14, and is coupled to an electric motor 15 to rotate the blades of fan 11 to generate an air flow. The electric motor 15 may be fixed to the sidewall of the housing 2 for support therein by a bracket or mounting plate 16. An orifice plate or ring 17 is integrally coupled to the inner wall of the housing 2 and forms an orifice adjacent the blades of fan 11.

An air flow is created by rotation of fan 11 by drawing air through a lower intake grill 20 suitably affixed to the bottom open end of housing 2. The interior defined by housing 2 forms an air passage whereby the circulating air is discharged through an upper rotatably mounted air discharge grill 21. Discharge grill 21 includes a plurality of deflector vanes 22, having a straight or other cross sectional configuration creating air passages therebetween, to direct the air flow generated by rotation of the fan blades 11 outward from the housing 2 in a desired direction. The discharge grill 21 is supported on an internal lip 23 formed in the top portion of housing 2 adjacent its upper end, and is capable of manual rotatable movement relative the housing to select the direction of air flow. Discharge grill 21 is also removably mounted on housing 2 to permit access to replace lamp 6. Any conventional retention means (not shown) in the form of a latch, threads, and the like, can be employed to retain the grill 21 on the housing 2. The grill may be constructed from any suitable material, such as, metal, plastic, and the like.

The air freshener section 30 is defined by a pair of spaced retainers 31 and 32 between which an air freshener material 33 such as an air filter and/or deodorizing substance in the form of a cartridge, is situated. The air flow created by rotation of the fan blades 11 is directed through or over the air freshener material 33 to filter and/or remove odors and otherwise freshen the air which is thereafter directed through the discharge grill 21. Access to the air freshener section to replace the air freshener material 30 is provided by a door 40 mounted on the wall of the housing 2 by a hinge 41. The hinged door 40 is comprised of a curved member extending half the circumference of the housing to permit opening and closing or, alternatively, may be comprised of a pair of identical members which are opened in opposite directions to provide complete access to the freshening material. In the case of a double door, a suitable brace opposite from the hinged connection (not shown) may be utilized to maintain the structural integrity of the housing by physically connecting the upper and lower compartments.

The device of the invention is portable in nature, and may be provided with suitable handle means (not shown) to permit carrying from place to place. In addition, legs may be provided, or other stand means (not shown), to permit the housing to stand on the floor or other support surface such as a desk, and the like.

In the form shown in FIGS. 1–4, the housing 2 is a self-contained unit capable of being secured to and supported from a standard electrical wall socket outlet. The housing includes an exterior electrical hole plug or contact member 50, of standard design, which is on the exterior of the housing 2 so that insertion into an electrical wall socket or receptacle not only supplies electrical power to the device, but also mounts the housing to the wall for support. A security clamp 51 is secured to the housing by any suitable means, to permit the clamp to extend outwardly from the housing. A curved end portion 53 is used to clamp over or engage the electrical socket plate to aid in retention of the device thereon.

As shown in FIGS. 3 and 4, the housing 2 may be oriented in various directions such as a vertical position shown in FIG. 3, or in a horizontal direction as shown in FIG. 4. In either orientation, the security clamp 51 may be used to secure the housing to the socket plate.

The housing 2 is also provided with a three-way switch 60 to permit selective activation of the device. The electrical potential supplied by the electrical wall outlet through electric plug 50 is electrically coupled to the light socket and fan motor by a suitable electrical circuit (not shown) in which the three-way switch 60 is connected. In one position of the three-way switch, the unit is off and no electrical potential to either the light 6 or fan motor 15 is supplied. In a second position of switch 60, only the light 6 is operated, and in a third position of the switch, both the light 6 and fan motor 16 may be operated to provide simultaneous illumination and freshened air circulation. It is within the scope of the invention to connect the switch 60 in the electrical circuit to operate the fan motor 15 to exclusion of the light, if so desired.

Referring now to FIGS. 5–11, there is illustrated therein another embodiment of the invention which also may be plugged into a standard electrical wall receptacle or socket to physically support and electrically couple the unit 1 to the socket. This particular embodiment, however, also permits the electrical socket into which the unit 1 is plugged, to be available for its normal purposes.

To this end, the housing 2 includes an illuminating compartment 3 which contains a standard light bulb socket 6, mounted on a wall **2*a* of the housing 2, for receiving a conventional lamp 7. A translucent, or non-opaque portion 3*a* covers the illuminating compartment. A fan compartment 4 is formed adjacent to the illuminating compartment 3, and contains a fan or impeller 11 secured to a shaft 12 of an electric motor 15 carried within the compartment 4. While the electric motors 15** utilized in this embodiment, as well as that of the previous embodiment, are alternating current motors, these motors may also be direct current motors coupled through a suitable transformer.

The motor 15 is secured to the wall **2*a* of the housing 2 by a suitable mounting 16, which positions the fan 11 to draw air through an air filtering and/or freshening medium 5*a* contained in a disposable packet 5 and discharge the air through grill openings 17. The packet 5 is supported in the housing 2 by suitable connecting tabs 5*b* which engage a pair of groves 5*c* in a wall of the housing and a lip/stop arrangement 5*d* to support the packet 5 in an opening of compartment 4 between two spaced wall extensions 4*a* and 4*b*. For further details concerning the air freshening packet 5, reference is made to copending application "DISPOSABLE AIR FRESHENING PACKET", Ser. No. 231,926, filed concurrently herewith in the names of the instant inventors, the disclosure of which is incorporated herein by reference. When the filtering and/or freshening material 5*a* contained within the packet 5 has been expended, the packet 5 may be readily removed and replaced. While various air filtering and/or freshening media may be used inside the packet 5**, a preferred medium is a felt pad saturated in a fragrance oil.

A pair of electrical switches 61 and 62 are connected to energize the lamp 7 and fan 11, respectively, to selectively operate these units. These switches are electrically connected to a pair of male electrical contact members 50, which are inserted into the wall receptacle to electrically couple the fan 11 and lamp 7 to the wall receptacle to be energized by actuation of switches 61 and 62. While two switches 61 and 62 are used in the preferred embodiment, a single multi-position type switch can be utilized to selectively effect the same operations.

Figure 5:
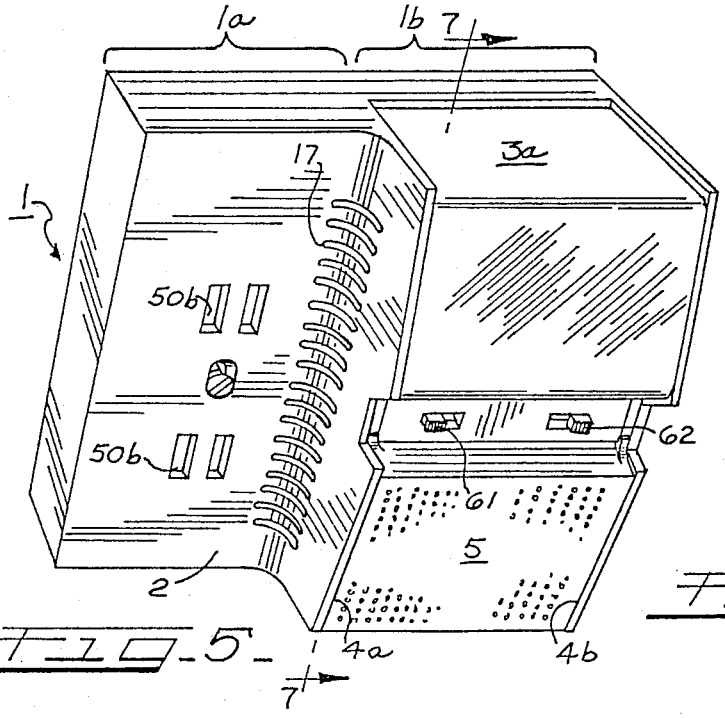
FIG. 5 is a frontal perspective view of a second embodiment of the invention wherein an electrical receptacle is provided with the illuminating and air freshening device.
Figure 11:
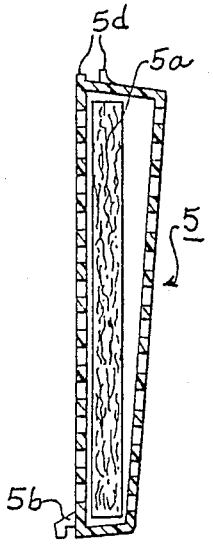
FIG. 11 is an enlarged cross-sectional view of a portion of the air freshening system.
Figure 10:
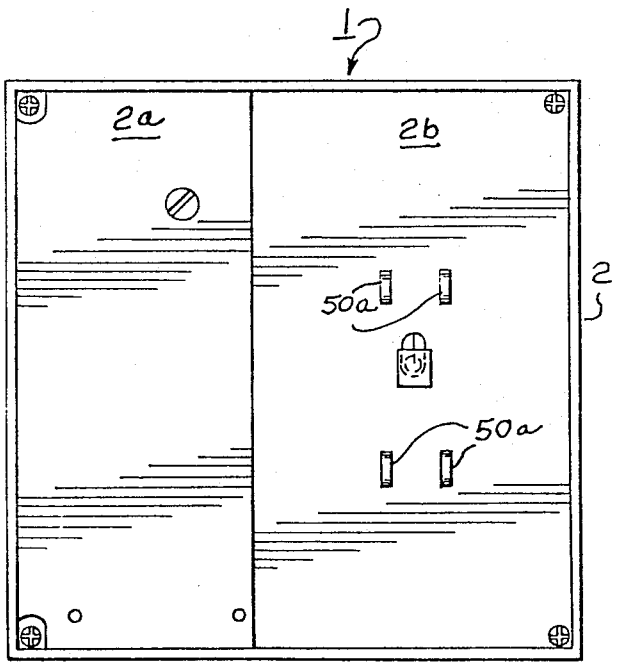
FIG. 10 is a rear profile view of the embodiment shown in FIG. 5.
Figure 9:
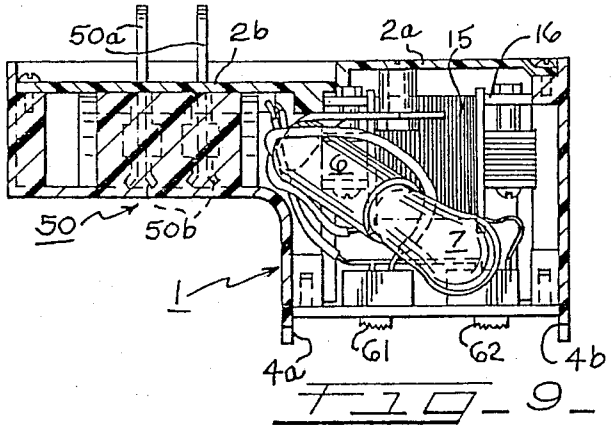
FIG. 9 is a cross-sectional view of the embodiment shown in FIG. 5 taken along line 9—9 of FIG. 6.
Figure 8:
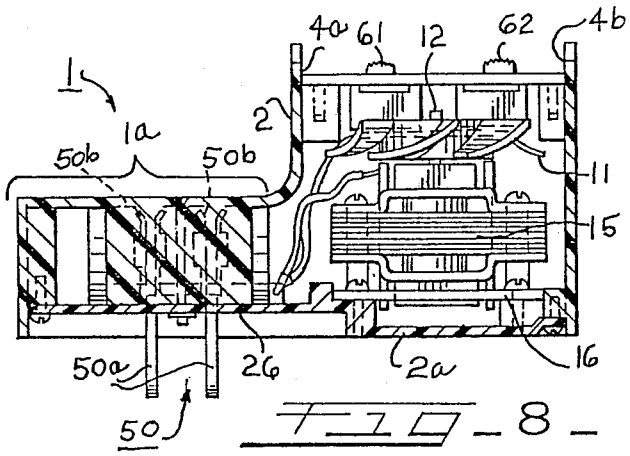
FIG. 8 is a cross-sectional view of the embodiment shown in FIG. 5 taken along line 8—8 of FIG. 6.

As best seen in FIGS. 5, 8 and 9, the illuminating and air freshening device 1 is constructed with a stepped portion, forming an electrical connection portion 1*a*, and an illuminating-air freshening portion 1*b*. In the electrical connection portion 1*a*, the pair of male electrical contact members or electrical plugs 50 are secured in a recessed back plate 2*b* of the casing 2 for insertion into a standard electrical receptacle as, for example, mounted on a wall. The size of the recessed back plate 2*b* is such that the face plate of the wall receptacle will be enclosed within the recess when the electrical contact members 50 are inserted into the wall receptacle, and the unit 1 will be both electrically coupled to and physically supported therefrom.

The electrical contact members 50 are of a type having a male connector at one end (50*a*) and a female connector at the other end (50*b*). In this manner, a standard electrical plug may be inserted into the female end 50*b* to form an electrical connection for the coupling of an electrical device to the electrical power source into which the male contact 50*a* has been inserted. Such a construction provides a suitable electrical outlet on portion 1*a* so that the standard electrical outlet, with which the unit 1 is connected, may still function to supply electrical power to various electrical devices when the illuminating and air freshening device 1 has been installed over the standard electrical receptacle.

While the electrical contacts 50*a* and 50*b* are illustrated as standard two-prong contacts, the two-prong electrical contact may also include a ground wire (not shown) to provide an electrical ground through the electrical receptacle with which the unit is connected. In addition the unit may utilize a standard three-prong grounded plug for use with a grounded electrical receptacle.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A portable illuminating and air freshening device to be electrically coupled to and supported from a standard wall-mounted electrical receptacle comprising a housing having an air inlet and an air outlet with a path for air flow therebetween, said housing further including security clamp means affixed to the exterior of said housing for connection to a wall receptacle plate to aid in the support thereof from the electrical socket, air circulating means carried by said housing and electrically energizable for drawing air thereinto through said air inlet and discharging the air drawn thereinto out through said air outlet, an externally mounted male electrical contact member carried on an outer portion of said housing and directly engageable into a wall mounted electrical receptacle having a female electrical contact for coupling a source of electrical power within said housing, said externally mounted male electrical plug member carried on an outer portion of said housing comprising a support for connecting said housing directly to the wall mounted electrical receptacle when physically inserted therein, and illuminating means carried by said housing and electrically energizable for emitting light therefrom, said air circulating means and said illuminating means being electrically coupled to said externally mounted male contact member for selective energization thereof in response to the coupling of electrical power thereto.

2. A portable illuminating and air freshening device to be electrically coupled to and supported from a standard wall-mounted electrical receptacle comprising a housing having an air inlet and an air outlet with a path for air flow therebetween, air circulating means carried by said housing and electrically energizable for drawing air thereinto through said air inlet and discharging the air drawn thereinto out through said air outlet, an externally mounted male electrical contact member carried on an outer portion of said housing and directly engageable into a wall mounted electrical receptacle having a female electrical contact for coupling a source of electrical power within said housing, said externally mounted male electrical plug member carried on an outer portion of said housing comprising a support for connecting said housing directly to the wall mounted electrical receptacle when physically inserted therein, said externally mounted male electrical contact member carried on an outer portion of said housing having at least one female electrical contact formed on a free end thereof for coupling the source of electrical power into which said male electrical contact member is engaged to a second male electrical contact member upon insertion thereof into said female electrical contact, and illuminating means carried by said housing and electrically energizable for emitting light therefrom, said air circulating means and said illuminating means being electrically coupled to said externally mounted male contact member for selective energization thereof in response to the coupling of electrical power thereto.

* * * * *